US008448352B2

(12) United States Patent
Ryu

(10) Patent No.: US 8,448,352 B2
(45) Date of Patent: May 28, 2013

(54) SOLE OF A SHOE FOR TRIPLE TIME WALKS AND WALKING REFORM

(75) Inventor: Jeong Hyeon Ryu, Busan (KR)

(73) Assignee: MESP Co., Ltd., Busan (KR)

( * ) Notice: Subject to any disclaimer, the term of this patent is extended or adjusted under 35 U.S.C. 154(b) by 525 days.

(21) Appl. No.: 12/648,857

(22) Filed: Dec. 29, 2009

(65) Prior Publication Data

US 2010/0236094 A1 Sep. 23, 2010

(30) Foreign Application Priority Data

Mar. 18, 2009 (KR) ..... 10-2009-0023166

(51) Int. Cl.
*A43B 13/14* (2006.01)

(52) U.S. Cl.
USPC ..... 36/25 R; 36/107; 36/142

(58) Field of Classification Search
USPC ..... 36/25 R, 107, 110, 31, 142–144
See application file for complete search history.

(56) References Cited

U.S. PATENT DOCUMENTS

| | | | | | |
|---|---|---|---|---|---|
| 2,616,190 | A | * | 11/1952 | Darby | 36/144 |
| 4,439,937 | A | * | 4/1984 | Daswick | 36/107 |
| 4,685,227 | A | * | 8/1987 | Simmons | 36/127 |
| 4,757,620 | A | * | 7/1988 | Tiitola | 36/28 |
| 5,507,106 | A | * | 4/1996 | Fox | 36/103 |
| 5,579,591 | A | * | 12/1996 | Kousaka et al. | 36/31 |
| 5,727,335 | A | * | 3/1998 | Kousaka et al. | 36/31 |
| 5,826,351 | A | * | 10/1998 | Tsuji | 36/25 R |
| 5,974,699 | A | * | 11/1999 | Park | 36/103 |
| 6,260,289 | B1 | * | 7/2001 | Tsuji | 36/103 |
| 7,877,897 | B2 | * | 2/2011 | Teteriatnikov et al. | 36/25 R |
| 7,886,460 | B2 | * | 2/2011 | Teteriatnikov et al. | 36/25 R |
| 7,941,940 | B2 | * | 5/2011 | Teteriatnikov et al. | 36/25 R |
| 2006/0117603 | A1 | * | 6/2006 | Park | 36/25 R |
| 2009/0064539 | A1 | * | 3/2009 | Park et al. | 36/88 |
| 2009/0077830 | A1 | * | 3/2009 | Lee | 36/108 |
| 2009/0199432 | A1 | * | 8/2009 | Park | 36/88 |
| 2010/0192416 | A1 | * | 8/2010 | Rees | 36/103 |

FOREIGN PATENT DOCUMENTS

| | | |
|---|---|---|
| KR | 200198697 | 10/2000 |
| KR | 200428361 | 10/2006 |
| KR | 100835732 | 6/2008 |
| WO | WO-2007/074978 | 7/2007 |

* cited by examiner

*Primary Examiner* — Marie Patterson
(74) *Attorney, Agent, or Firm* — Jordan and Hamburg LLP

(57) ABSTRACT

A sole of a shoe for triple time walks and walking reform has a bottom surface which includes a front rolling portion, a middle rolling portion and a rear rolling portion, wherein the front, the middle and the rear rolling portions of the sole are slanted upwards at a predetermined angle of inclination and thereby form a substantially arc shape. The middle rolling portion is made of a rigid material having a rigidity substantially greater than the front and the rear rolling portions and the middle rolling portion protrudes from the bottom surface of the sole beyond the front and the rear rolling portions.

5 Claims, 8 Drawing Sheets

SOLE OF A SHOE FOR TRIPLE TIME WALKS AND WALKING REFORM

BACKGROUND OF THE INVENTION

1. Field of the Invention

The present invention relates generally to a sole of a shoe for triple time walks and walking reform, and more particularly to a sole of a shoe for triple time walks and walking reform, which is capable of reforming one's manner of walking by preventing a wearer from turning his or hers toes out and by allowing the wearer to perform triple time walks during the entire walking gait cycle of the wearer, wherein three rolling portions respectively having a substantially arc shape are provided on a bottom surface of the sole in a manner that both ends of the front, the middle and the rear rolling portions are slanted upwards from the bottom of the sole at a predetermined angle of inclination and thereby forming a substantially arc shape on the whole, in which the middle rolling portion is made of a rigid material having a rigidity or stiffness substantially greater than the front and the rear rolling portions, and the middle rolling portion protrudes from the bottom of the sole beyond the front and the rear rolling portions, in which the height and the width of a lateral portion of the middle rolling portion are larger than those of a medial portion of the middle rolling portion.

In addition, the present invention relates more particularly to a sole of a shoe for triple time walks and walking reform, which is capable of reforming one's manner of walking by preventing a wearer from turning his or hers toes in such as a step of a bow-legged person and by allowing the wearer to perform triple time walks during the entire walking gait cycle of the wearer, wherein three rolling portions respectively having a substantially arc shape are provided on a bottom surface of the sole in a manner that both ends of the front, the middle and the rear rolling portions are slanted upwards from the bottom of the sole at a predetermined angle of inclination and thereby forming a substantially arc shape on the whole, in which the middle rolling portion is made of a rigid material having a rigidity or stiffness substantially greater than the front and the rear rolling portions, and the middle rolling portion protrudes from the bottom of the sole beyond the front and the rear rolling portions, in which the height and the width of a medial portion of the middle rolling portion are larger than those of a lateral portion of the middle rolling portion.

2. Description of the Prior Art

Generally, many different types of shoes for reforming one's manner of walking by preventing a wearer from turning his or hers toes out during the entire walking gait cycle of the wearer have been available in the market. See for example, Korean Utility Model Registration No. 20-0198697, which was filed on Apr. 28, 2000 in Korean Utility Model Application No. 20-2000-0012227, which discloses an insole for shoes.

In such Korean Utility Model Registration No. 20-0198697, a cushioning member having good elastic air cushioning and shock-absorbing effects for relieving foot pressure is attached to the whole lower surface of the insole for shoes in such a manner that a front portion of the cushioning member is gradually slanted upwards at a predetermined angle of inclination and thereby providing good elastic air cushioning and shock-absorbing effects for relieving foot pressure. Due to operation of this cushioning member, it is possible to improve walking posture of the wearer to efficiently walk in a very natural way by preventing the wearer from turning his or her toes out and by preventing the wearer from walking abnormally.

However, a drawback of such known insole for aid of walking is that the wearer certainly has a tendency to feel extremely tired during walking and the accompanying rolling of the foot for a long time. Since the upwardly rounded cushioning member is attached to the whole lower surface of the insole, the sole of the foot is always inclined inwards and the leg of the wearer corresponding to the shoe upper is always maintained at an upright state.

Since the ankle of the wearer is always maintained at an inclined state in a predetermined angle of incline for a long time, the muscle and the nerves of the ankle are also curved abnormally for a long time and thereby resulting in injury of the ankle while the wearer resting his or her weight on the ankle during walking gait cycle of the wearer.

SUMMARY OF THE INVENTION

In consideration of the above-mentioned disadvantages or inconveniences of the conventional midsole, a first object of the present invention is to provide a sole of a shoe for triple time walks and walking reform, which is capable of reforming one's manner of walking by preventing a wearer from turning his or hers toes out and by allowing the wearer to perform triple time walks during the entire walking gait cycle of the wearer, wherein three rolling portions respectively having a substantially arc shape are provided on a bottom surface of the sole in a manner that both ends of the front, the middle and the rear rolling portions are slanted upwards from the bottom of the sole at a predetermined angle of inclination and thereby forming a substantially arc shape on the whole, in which the middle rolling portion is made of a rigid material having a rigidity or stiffness substantially greater than the front and the rear rolling portions, and the middle rolling portion protrudes from the bottom of the sole beyond the front and the rear rolling portions, in which the height and the width of a lateral portion of the middle rolling portion are larger than those of a medial portion of the middle rolling portion.

In addition, a second object of the present invention is to provide a sole of a shoe for triple time walks and walking reform, which is capable of reforming one's manner of walking by preventing a wearer from turning his or hers toes in such as a step of a bow-legged person and by allowing the wearer to perform triple time walks during the entire walking gait cycle of the wearer, wherein three rolling portions respectively having a substantially arc shape are provided on a bottom surface of the sole in a manner that both ends of the front, the middle and the rear rolling portions are slanted upwards from the bottom of the sole at a predetermined angle of inclination and thereby forming a substantially arc shape on the whole, in which the middle rolling portion is made of a rigid material having a rigidity or stiffness substantially greater than the front and the rear rolling portions, and the middle rolling portion protrudes from the bottom of the sole beyond the front and the rear rolling portions, in which the height and the width of a medial portion of the middle rolling portion are larger than those of a lateral portion of the middle rolling portion.

In order to achieve the objects, the present invention provides a sole of a shoe for triple time walks and walking reform of the type in which it constitutes a front rolling portion, a middle rolling portion and a rear rolling portion, wherein the front, the middle and the rear rolling portions of a bottom surface of the sole are slanted upwards at a predetermined angle of inclination and thereby forming a substantially arc shape on the whole, the improvement comprising: the middle rolling portion is made of a rigid material having a rigidity or stiffness substantially greater than the front and the rear rolling portions, and the middle rolling portion protrudes from the bottom surface of the sole beyond the front and the rear rolling portions.

The height and the width of a lateral portion of the middle rolling portion are larger than those of a medial portion of the middle rolling portion in order to reform one's manner of walking by preventing a wearer from turning his or her toes out and by allowing the wearer to perform triple time walks during the entire walking gait cycle of the wearer. Alternatively, the height and the width of a medial portion of the middle rolling portion are larger than those of a lateral portion of the middle rolling portion in order to reform one's manner of walking by preventing a wearer from turning his or hers toes in such as a step of a bow-legged person and by allowing the wearer to perform triple time walks during the entire walking gait cycle of the wearer.

As described above, in the sole according to the present invention, the shoe sole for triple time walks and walking reform constitutes a front rolling portion, a middle rolling portion and a rear rolling portion, wherein the front, the middle and the rear rolling portions of a bottom surface of the sole are slanted upwards at a predetermined angle of inclination and thereby forming a substantially arc shape on the whole. If a wearer puts on a shoe employing the shoe sole and walks on a road, then the rear side, the middle portion and the toe portion of the shoe may be touched with the ground in sequence with performing triple time walks and accompanying rolling of the foot. Accordingly, it is possible to improve walking posture of the wearer to efficiently walk in a very natural way and to promote his or her comfort and health.

In addition, by controlling the height and the width of the middle rolling portion in accordance with the purpose of using, it is possible to reform one's manner of walking by preventing a wearer from turning his or her toes out and by allowing the wearer to perform triple time walks during the entire walking gait cycle of the wearer. Likewise, it is possible to reform one's manner of walking by preventing a wearer from turning his or hers toes in such as a step of a bow-legged person and by allowing the wearer to perform triple time walks during the entire walking gait cycle of the wearer.

Due to the structure of the bottom surface of the sole, the front portion of the sole of the foot is always maintained at an equilibrium state so that the ankle of the wearer will not have any attack of injury. The ankle of the wearer only may be rotated inwards at the time that the middle rolling portion is contacted with the ground and it does not rotate at the time that the front and the rear rolling portions are contacted with the ground. Accordingly, when a user walks along the street with wearing on the shoe employing the shoe sole according to the present invention, the cycle of a rotation, a rotation stop and an upright state of the ankle may be repeated due to the structure and the operation of the shoe sole. Because the ankle of the wearer can be rhythmically rotated, it is possible to prevent the wearer from turning his or hers toes out and to softly train the ankle.

BRIEF DESCRIPTION OF THE DRAWINGS

The above object and other characteristics and advantages of the present invention will become more apparent by describing in detail preferred embodiments thereof with reference to the attached drawings, in which:

FIGS. 3 to 7 show a preferred second embodiment of the present invention, in which, FIG. 3 is a bottom end perspective view of the shoe sole according to the preferred second embodiment of the present invention, FIG. 4 is a perspective view of a hardened reinforcement sheet to be installed in the shoe sole according to the preferred second embodiment of the present invention as illustrated in FIG. 3, FIG. 5 is a bottom view of the shoe sole according to the preferred second embodiment of the present invention, FIG. 6 is a sectional view taken along line "B-B" shown in FIG. 5, and FIG. 7 is a sectional view taken along line "C-C" shown in FIG. 5;

FIGS. 8 to 12 show a preferred third embodiment of the present invention, in which, FIG. 8 is a bottom end perspective view of the shoe sole according to the preferred third embodiment of the present invention, FIG. 9 is a perspective view of a hardened reinforcement sheet to be installed in the shoe sole according to the preferred third embodiment of the present invention as illustrated in FIG. 8, FIG. 10 is a bottom view of the shoe sole according to the preferred third embodiment of the present invention, FIG. 11 is a sectional view taken along line "F-F" shown in FIG. 10, and FIG. 12 is a sectional view taken along line "G-G" shown in FIG. 10;

FIGS. 13 and 14 show internal structures to be commonly applied to the shoe sole according to the preferred embodiments of the present invention as mentioned above, in which, FIGS. 13A to 13D are sectional views of cushioning members according to a preferred first embodiment to a preferred fourth embodiment which is to be installed the shoe sole of the present invention, respectively and FIG. 14 is an expanded view of the "A" part, for the sake of clarity, as illustrated in FIG. 13A.

DETAILED DESCRIPTION OF THE INVENTION

Figure 1:
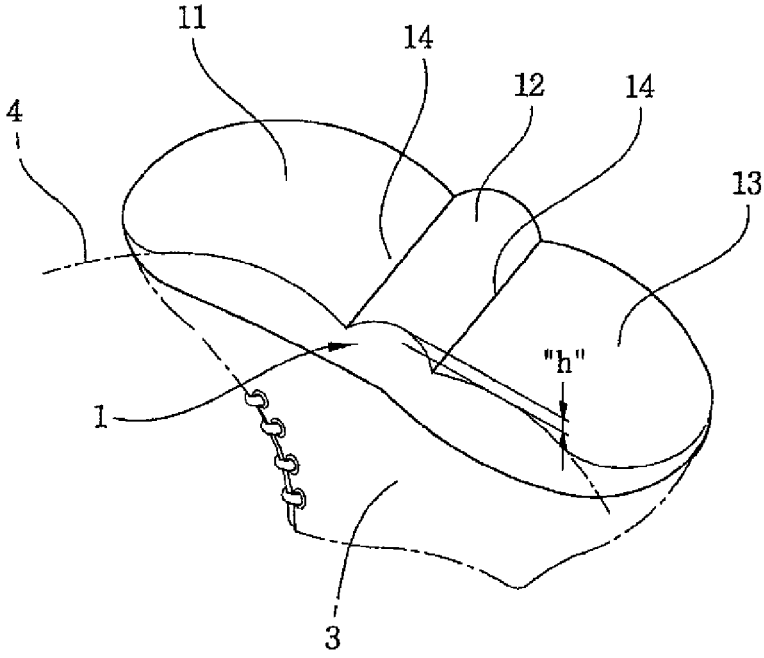
FIG. 1 is a bottom end perspective view of a shoe sole according to a preferred first embodiment of the present invention.

Hereinafter, the constitution and the operation of shoe soles according to the preferred embodiments of the present invention will be explained in more detail with reference to the accompanying drawings FIGS. 1 to 14.

Prior to proceeding to the more detailed description of the preferred embodiments according to the present invention, it should be noted that, for the sake of clarity and understanding of the invention identical components which have identical functions have been identified with identical reference numerals throughout the different views which are illustrated in each of the attached drawing Figures.

Figure 2:
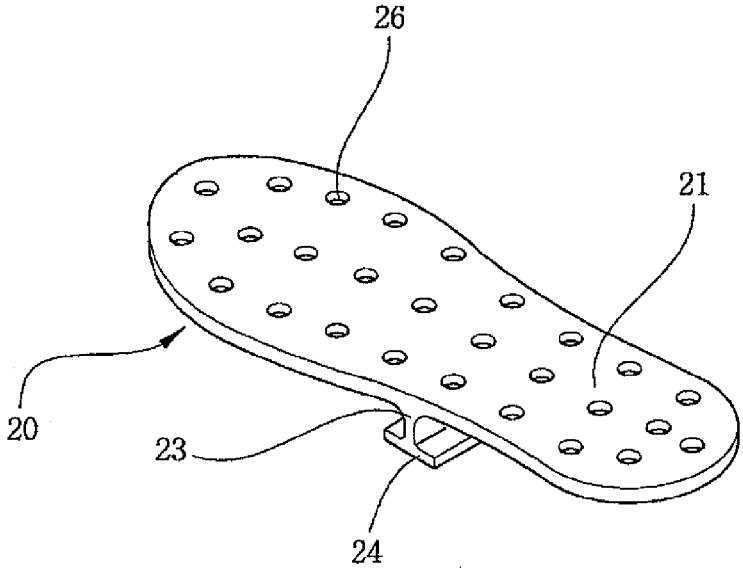
FIG. 2 is a perspective view of a hardened reinforcement sheet to be installed in the shoe sole according to the preferred first embodiment of the present invention as illustrated in FIG. 1.
Figure 13:
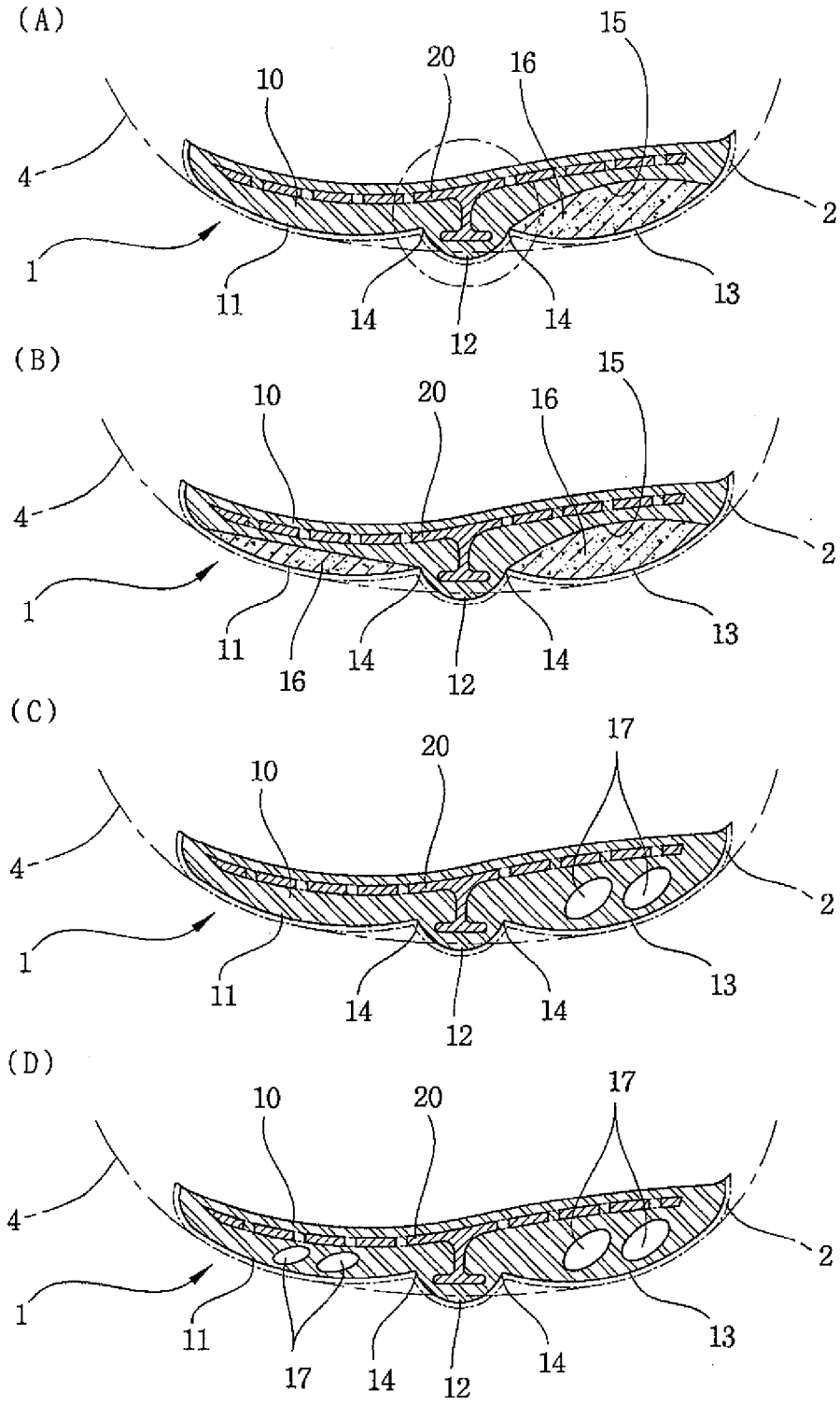
Figure 14:
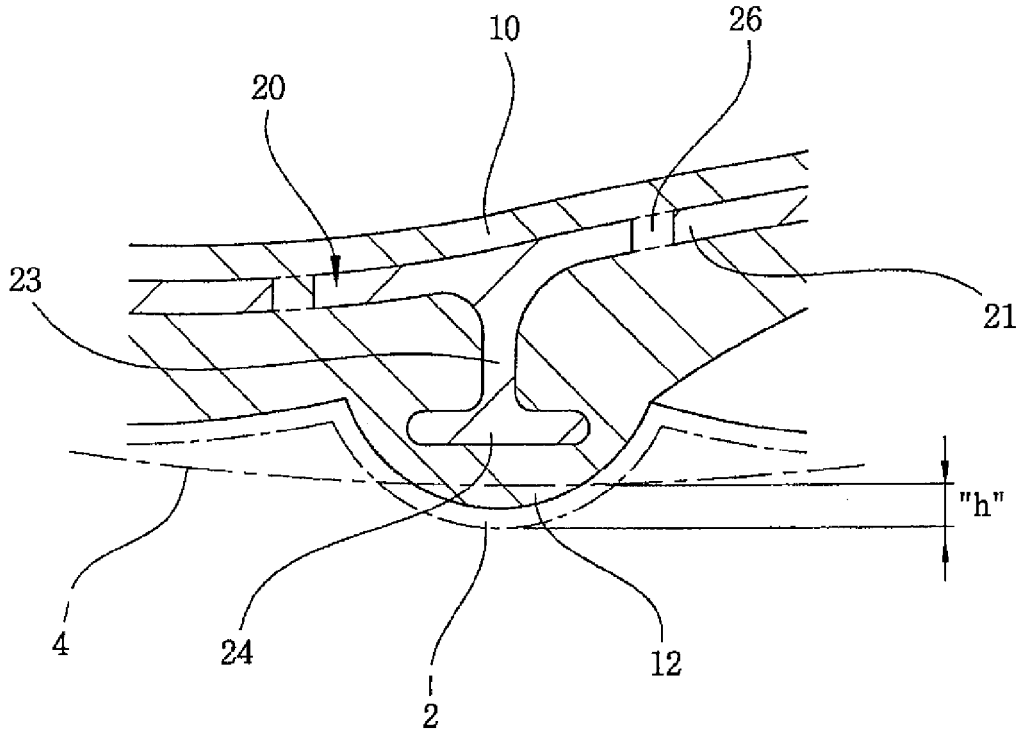

At first, FIGS. 1 and 2 relate to a shoe sole for triple time walks and walking reform, which is capable of allowing the wearer to perform triple time walks during the entire walking gait cycle of the wearer, without reforming walking abnormalities. Alternatively, FIGS. 3 to 7 relate to a shoe sole capable of reforming one's manner of walking by preventing a wearer from turning his or hers toes out and by allowing the wearer to perform triple time walks during the entire walking gait cycle of the wearer. Alternatively, FIGS. 8 to 12 relate to a shoe sole capable of reforming one's manner of walking by preventing a wearer from turning his or hers toes in such as a step of a bow-legged person and by allowing the wearer to perform triple time walks during the entire walking gait cycle of the wearer. Finally, FIGS. 13 and 14 show internal structures that can be commonly applied to the shoe soles according to the preferred embodiments of the present invention as mentioned above.

Figure 3:
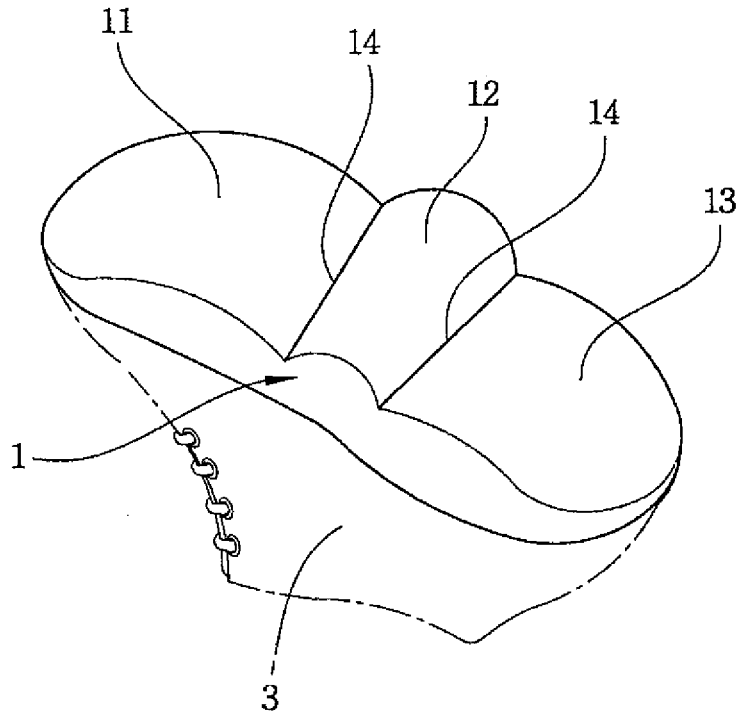
Figure 8:
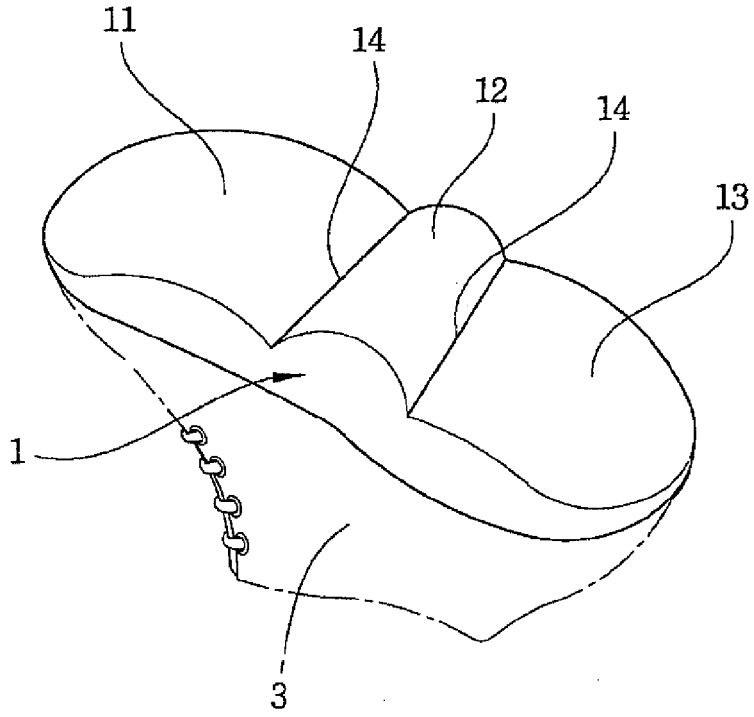

In the following descriptions, a bottom surface of a middle rolling portion 12 is commonly shaped as a circular arc shape in the shoe soles according to the preferred embodiments of the present invention as mentioned above. In more detail, in the first embodiment according to the present invention, the middle rolling portion 12 is shaped as a semi-circular shape as shown in FIG. 1. Alternatively, in the second embodiment according to the present invention, the middle rolling portion 12 is shaped as a circular truncated cone shape as shown in FIGS. 3 and 8. At this time, the angle of inclination of the bottom surface of the middle rolling portion 12 as illustrated in FIG. 3 is contrary to that of the bottom surface of the middle rolling portion 12 as illustrated in FIG. 8.

Now referring to FIGS. 1 and 2, in the shoe sole 1 according to the preferred first embodiment of the present invention constitutes a front rolling portion 11, a middle rolling portion 12 and a rear rolling portion 13, wherein three rolling portions respectively having a substantially arc shape are provided on a bottom surface of the sole 1 in a manner that both ends of the front, the middle and the rear rolling portions 11,12,13 are slanted upwards from the bottom of the sole 1 at a predetermined angle of inclination and thereby forming a substantially arc shape on the whole. The middle rolling portion 12 protrudes from the bottom of the sole beyond the front and the rear rolling portions 11,13. At this time, the height of root surfaces of the front and the rear rolling portions 11,13 is higher than that of a root surface of the middle rolling portion 12 so that the bottom surfaces of the front, middle and rear rolling portions 11,12,13 may be shaped as an imaginary substantially arc shape on the whole.

Two valley portions 14 are provided at a connecting position between the front rolling portion 11 and the middle rolling portion 12 and at another connecting position between the middle rolling portion 12 and the rear rolling portion 13. As will be illustrated below, this structure may be help to perform triple time walks and walking reform during the entire walking gait cycle of the wearer.

Referring to FIGS. 2 and 14, a hardened reinforcement sheet 20 is installed in a main body 10 of the sole 1. The hardened reinforcement sheet 20 includes a supporting portion 23 protruding from a bottom surface of a bottom plate 21 at a middle area thereof. The supporting portion 23 is inserted into the middle rolling portion 12.

Hereinafter, the constitution and the operation of the shoe sole according to the preferred second embodiment of the present invention, which is capable of reforming one's manner of walking by preventing a wearer from turning his or hers toes out during the entire walking gait cycle of the wearer, will be explained in more detail with reference to the accompanying drawings FIGS. 3 to 7, FIGS. 13 and 14.

Referring to FIGS. 3 to 6, a middle rolling portion 12 protrudes from the bottom surface of the shoe sole 1 at a middle position thereof. The lower surface of the middle rolling portion 12 is shaped as a substantially arc shape. The middle rolling portion 12 has a half circular truncated cone shape on the whole. At this time, the height of a lateral portion of the middle rolling portion 12 is larger than that of a medial portion of the middle rolling portion 12. Also, the width of a lateral portion of the middle rolling portion 12 is larger than that of a medial portion of the middle rolling portion 12.

Figure 6:
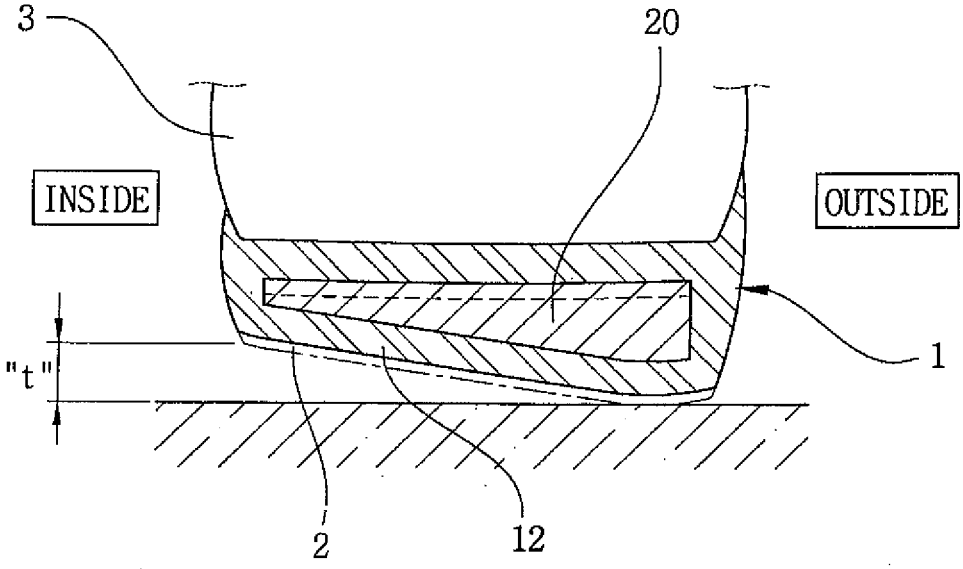

The reference numeral "t" as illustrated in FIG. 6 applies to apparently show the fact that the height of the lateral portion of the middle rolling portion 12 is larger than that of the medial portion of the middle rolling portion 12.

Figure 4:
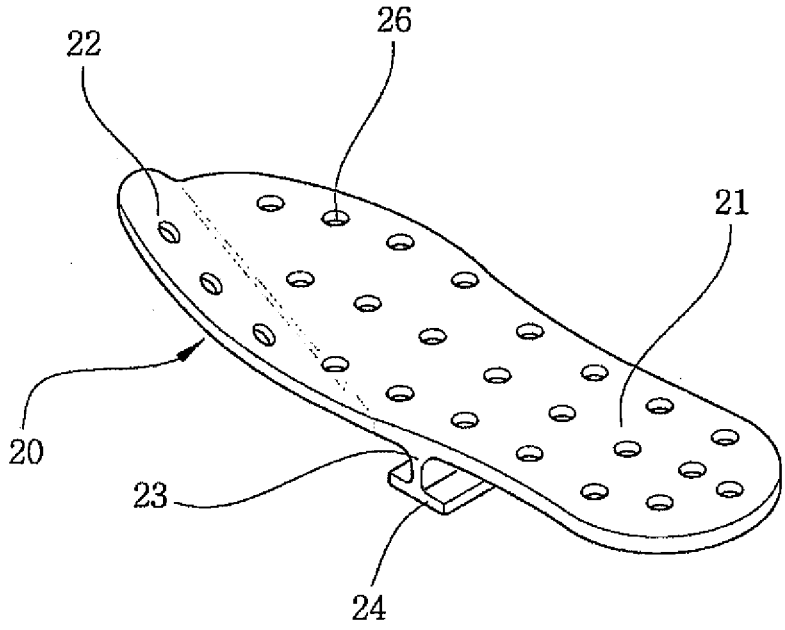

As described above, the hardened reinforcement sheet 20 is disposed within the main body 10 of the shoe sole 1 in such a manner that it has the supporting portion 23 protruding from a bottom surface of the bottom plate 21 at a middle area thereof and a medial upwards rounded portion 22. As best seen in FIG. 4, a front medial portion of the bottom plate 21 is rounded upwards at a predetermined angle of inclination so that it creates the medial upwards rounded portion 22. The supporting portion 23 may be installed in the middle rolling portion 12.

At this time, the supporting surface 24 may be formed as a flat surface so as to enlarge a supporting surface area. Since the supporting portion 23 is inserted into the middle rolling portion 12, the middle rolling portion 12 may not be constricted so that it can function as a supporter of a seesaw.

FIGS. 13 and 14 show internal structures to be commonly applied to the shoe sole according to the preferred embodiments of the present invention as mentioned above.

As shown in FIGS. 13 and 14, a connecting line 4 that is tangential to the lower surfaces between the front, the middle and the rear rolling portions 11,12,13 may be shaped as an imaginary substantially arc shape on the whole. The middle rolling portion 12 downwardly protrudes beyond the connecting line 4 at a predetermined height (h) as best seen in FIG. 14.

As described above, since the bottom surfaces of the front, the middle and the rear rolling portions 11,12,13 may be shaped as an imaginary substantially arc shape on the whole, two valley portions 14 are created at the connecting position between the front rolling portion 11 and the middle rolling portion 12 and at the another connecting position between the middle rolling portion 12 and the rear rolling portion 13.

FIGS. 13A to 13D are sectional views of a cushioning member that can be applied to the preferred first embodiment to the preferred third embodiment according to the present invention, in which the cushioning member may be installed into the rear rolling portion 13 or the front and the rear rolling portions 11,13 of the shoe sole 1, respectively.

At first, referring to FIG. 13A for showing the first embodiment of the cushioning member, a shock-absorbing recess 15 is defined in an underside of the rear side of the main body 10. A cushioning member 16 of which a lower surface has a substantially arc shape is attached to a medial surface of the shock-absorbing recess 15.

Alternatively, referring to FIG. 13B for showing the second embodiment of the cushioning member, two shock-absorbing recesses 15 are defined in undersides of front and rear sides of the main body 10, respectively. The cushioning member 16 is attached to a medial surface of the shock-absorbing recess 15, respectively.

The cushioning member 16 may be formed usually of a predetermined material that is relatively excellent in cushioning effects and is softer than the raw material of the main body 10 of the shoe sole 1. It is preferred that the cushioning member 16 consists essentially of a soft material such as thermoplastic polyurethane-series resin. The cushioning member 16 may be made by using thermoplastic polyurethane-series resin as a material for a resin member constituting a molded composite article such as by being injection molded, which is a substance that is formed by trapping many gas bubbles in the thermoplastic polyurethane-series resin. It is preferred that the cushioning member 16 may be enclosed by a waterproof cover made of a material such as a vinyl that does not hydrolyze.

Alternatively, referring to FIG. 13C for showing the third embodiment of the cushioning member, at least one tunnel-type through hole 17 is formed through at the rear side of the main body 10. In other words, since shock-absorbing spaces corresponding to the through holes 17 are created in the main body 10 of the shoe sole 1 due to the formation of the through holes 17, and thereby resulting in the excellent shock-absorbing effects.

Finally, referring to FIG. 13D for showing the fourth embodiment of the cushioning member, at least one tunnel-type through hole 18 is formed through at the front side and the rear side of the main body 10, respectively. At this time, the through holes 18 are formed through the main body 10 in the horizontal direction.

Although the invention is described with respect to specific embodiments employing the cushioning member for providing the wearer with cushioning effects, it will readily be understood that an airbag for a shoe can be installed in the front side and/or the rear side of the main body 10 of the shoe sole 1, in order to ensure cushioning effects.

FIGS. 8 to 12 show the shoe sole 1 according to the preferred third embodiment of the present invention, which is capable of reforming one's manner of walking by preventing a wearer from turning his or her toes in such as a step of a bow-legged person during the entire walking gait cycle of the wearer.

The internal structure of the shoe sole 1 according to the third embodiment of the present invention is the same as that of the shoe sole 1 according to the first embodiment of the present invention as illustrated with reference to FIGS. 3 to 7, except for the structure of the middle rolling portion 12 and the formation of a lateral upwards rounded portion 25.

In detail, the extension direction of the middle rolling portion 12 according to the third embodiment of the present invention is contrary to that of the middle rolling portion 12 according to the first embodiment of the present invention. Furthermore, contrary to the formation of the medial upwards rounded portion 22 at the hardened reinforcement sheet 20 in the first embodiment of the present invention, the lateral upwards rounded portion 25 is provided at a front lateral portion of the hardened reinforcement sheet 20 in the third embodiment of the present invention. It should be noted that, for the sake of clarity, the detailed description of other constitutional parts of the shoe sole, which are the same as those of the shoe sole according to the first embodiment of the present invention, will be omitted.

As shown in FIGS. 8 to 12, in the shoe sole 1 according to the preferred third embodiment of the present invention, the middle rolling portion 12 of which a lower surface has a substantially arc shape downwardly protrudes from the bottom surface of the shoe sole 1 at a middle area thereof. At this time, the height and the width of a medial portion of the middle rolling portion 12 are larger than those of a lateral portion of the middle rolling portion 12.

Figure 9:
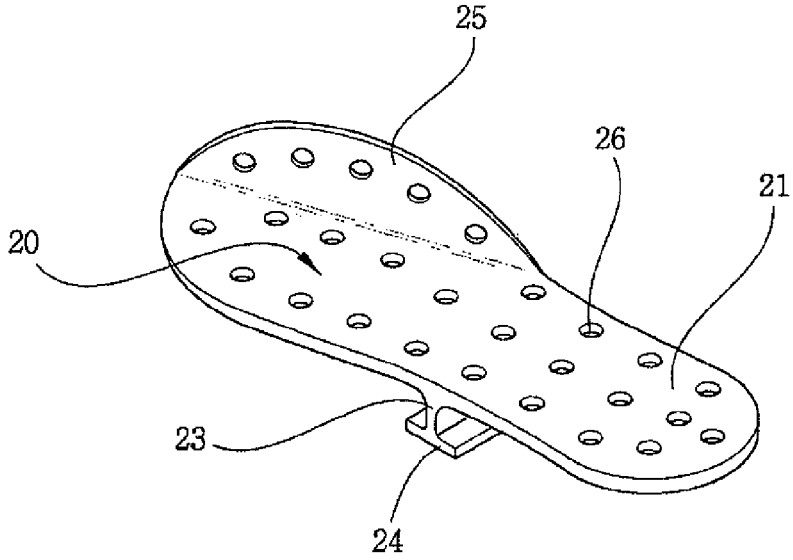
Figure 11:
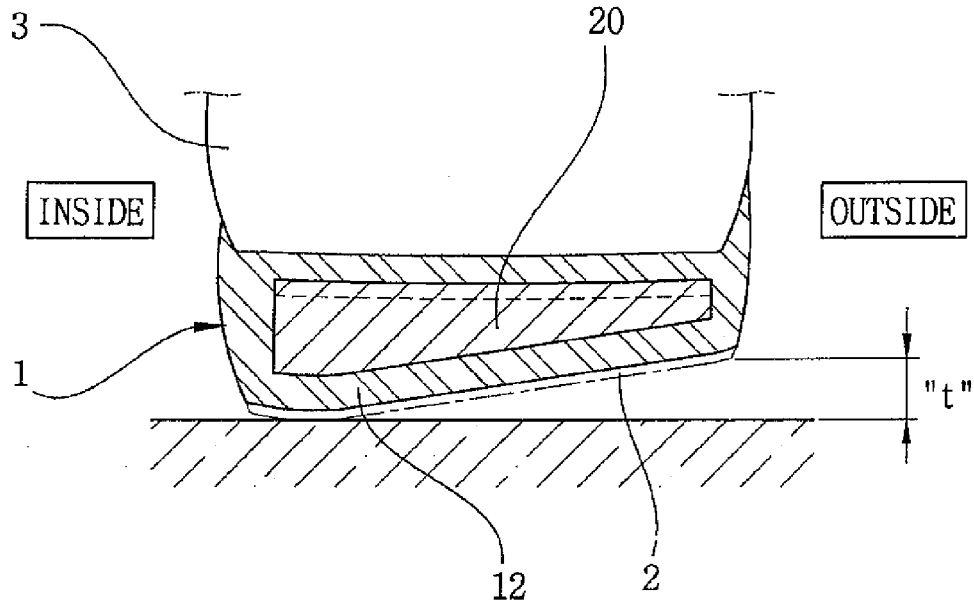
Figure 12:
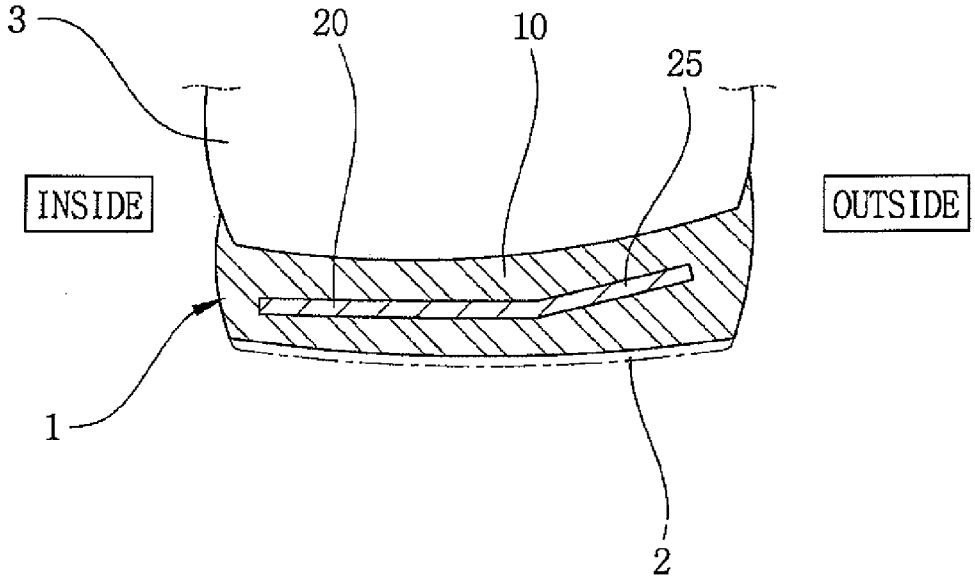

In the meantime, referring to FIGS. 11 and 12, a hardened reinforcement sheet 20 is installed in a main body 10 of the sole 1. As best seen in FIG. 9, the hardened reinforcement sheet includes a supporting portion 23 protruding from a bottom surface of a bottom plate 21 at a middle area thereof. At this time, a front lateral portion of the bottom plate 21 is rounded upwards so that it creates an upwards rounded portion 25.

A supporting surface 24 may be selectively formed at a lower end of the supporting portion 23 as a flat surface so as to enlarge a supporting surface area. Since the supporting portion 23 is inserted into the middle rolling portion 12, the middle rolling portion 12 does not contract so that it can function as a fulcrum.

As described above, FIGS. 13 and 14 show the installation states of the cushioning member to be commonly applied to the shoe sole according to the preferred embodiments of the present invention as mentioned above.

The reference numeral "2" as shown in FIGS. 13 and 14 represents a non-ship shoe sole. Although the non-slip shoe sole 2 may be typically attached to a lower surface of the main body 10 of the sole, it will readily be understood that the non-slip shoe sole 2 can be directly formed by forming protrusions and depressions on the lower surface of the main body 10 of the sole as shown in FIGS. 13C and 13D.

As best shown in FIG. 14, a plurality of through holes 26 are formed through the hardened reinforcement sheet 20 inserted in the shoe sole 1. The thermoplastic polyurethane-series resin used as a material for a resin member constituting the main body 10 of the sole passes through and thereby resulting in strong engagement between the hardened reinforcement sheet 20 and the main body 10 of the sole.

Having described shoe sole according to the preferred embodiments of the present invention in detail, the operation of the shoe sole 1 can be understood as follows with reference to FIGS. 1 to 14.

If a wearer puts on a shoe employing the shoe sole 1 attached to a lower part of the shoe upper 3 as described above and walks on a road, then the rear lower side of the rear rolling portion 13 corresponding to the heal zone of the shoe may be touched with the ground at first and continuously the lower surfaces of the middle and the front rolling portions 12,11 may be touched with the ground in sequence with accompanying rolling of the foot.

At this time, the cushioning means installed in the rear rolling portion 13 provides good shock-absorbing effects during walking and the accompanying rolling of the foot.

Since the middle rolling portion 12 protrudes from the lower surface of the shoe sole 1 beyond the front and the rear rolling portions 11,13 at a predetermined height (h) as best seen in FIG. 14 and the supporting portion 23 and the supporting surface 24 are provided in the middle rolling portion 12, the rear rolling portion 13 corresponding to the heal zone of the shoe may be quickly moved up and then may be slanted to the front side at the time that the middle rolling portion 12 is contacted with the ground.

Because the supporting portion 23 inserted into the middle rolling portion 12 functions as a supporter of a seesaw, the rear rolling portion 13 may be slanted to the front side. Due to the existence of the supporting portion 23 inserted into the middle rolling portion 12, the middle rolling portion 12 is relatively less constricted than the front and the rear rolling portions 11,13 so that the middle rolling portion 12 functions as a supporter of a seesaw and thereby resulting in inclination of the rear rolling portion 13 to the front side.

Thereafter, the front rolling portion 11 is contacted with the ground and thereby the wearer has a tendency to naturally perform triple time walks during walking and the accompanying rolling of the foot.

As the shoes and the sole of the foot move in accordance with a predetermined walking course of the wearer while performing the triple time walks, the body of the wearer has a tendency to instantly correspond to the triple time walks.

Accordingly, the muscle and the nerves in the body from the sole of the foot to the neck of the wearer may instantly corresponding to the triple time walks so that it is possible to maintain a balance of the body and to smoothly walk during walking and the accompanying rolling of the foot.

Under this state, in the shoe sole according to the preferred first embodiment as shown in FIGS. 1 and 2, it is possible to perform triple time walks during walking and the accompanying rolling of the foot in such a manner that the lower surfaces of the rear, the middle and the front rolling portions 13,12,11 may be touched with the ground in sequence. As a result, the general people normally walking can perform triple time walks during walking and the accompanying rolling of the foot with the aid of the shoe sole 1 according to the present invention.

Figure 5:
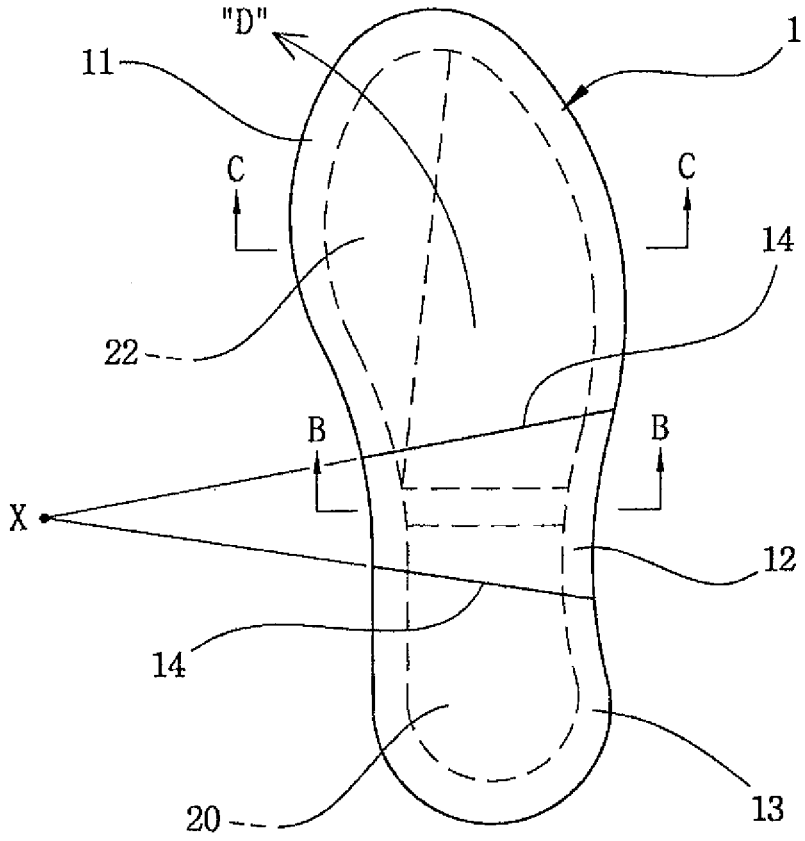

In the shoe sole according to the preferred second embodiment as shown in FIGS. 3, 5 and 6, at the time that the middle rolling portion 12 is contacted with the ground during walking and the accompanying rolling of the foot, the shoe may be rotated around an imaginary rotational center position (x) that is located at a position adjacent to the medial side of the shoe as illustrated in the rotational direction of the arrow "D" in FIG. 5.

This operation is caused by the fact that the middle rolling portion 12 is shaped as a circular truncated cone shape and a slope of the medial side of the bottom surface of the middle rolling portion 12 is different to that of the lateral side of the bottom surface of the middle rolling portion 12. The rotation of the shoe as described above performs in the same manner as the traveling of the bicycle on a velodrome provided in the playground of a cycle of which a slope of a radial outside track is higher than that of a radial inside track.

If a toe portion of the shoe sole 1 is rotated to the inside due to operation of the middle rolling portion 12, an lateral edge portion of the sole of the foot may move upwards and continuously the medial portion of the sole of the foot may be inclined inwards. Due to this, if an ankle of the wearer is weak, it will have an attack of injury.

Figure 7:
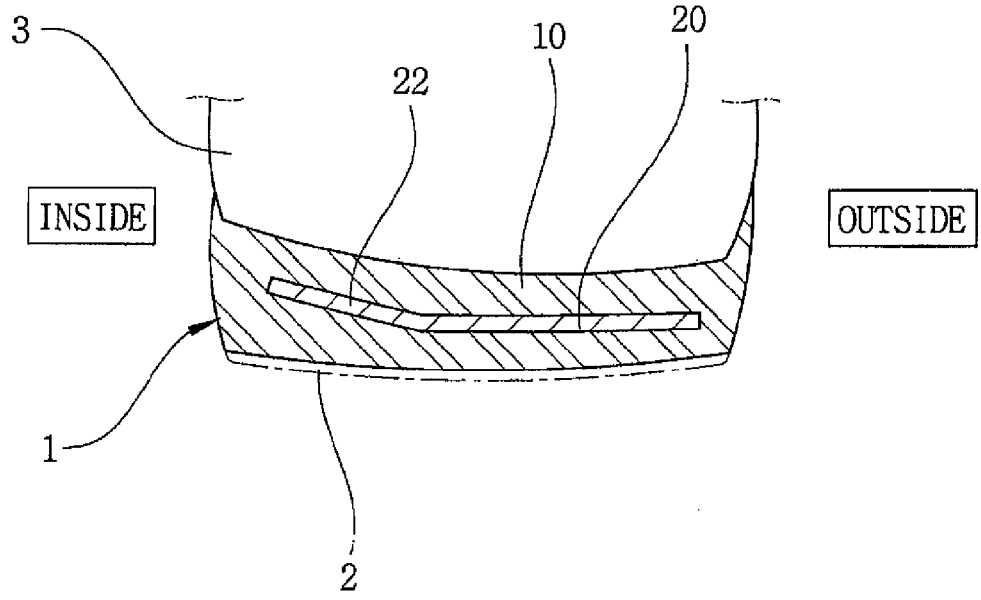

As shown in FIGS. 4 and 7, since a front medial portion of the hardened reinforcement sheet 20 is rounded upwards and thereby resulting in creation of the medial upwards rounded portion 22, the medial upwards rounded portion 22 may upwardly support the lateral edge portion of the sole of the foot. Due to this structure, the front portion of the sole of the foot is always maintained at an equilibrium state so that the ankle of the wearer will not have any attack of injury.

After accomplished the equilibrium state of the sole of the foot due to operation of the medial upwards rounded portion 22, it is possible to prevent the wearer from turning his or her toes out during the rotation of the middle portion of the sole of the foot and the ankle of the wearer. When the ankle of the wearer is rotated inwards at the middle rolling portion 12, the ankle of the wearer stops to rotate inwards at the time that the front rolling portion 11 is contacted with the ground.

If the toe portion of the shoe sole 1 stop to rotate inwards, the walking and the accompanying rolling of the foot can be occurred at the front rolling portion 11. Then, the rear rolling portion 13 is touched with the ground and thereafter the middle portion 12 is contacted with the ground again during walking and the accompanying rolling of the foot. The ankle of the wearer only may be rotated inwards at the time that the middle rolling portion 12 is contacted with the ground and it does not rotate at the time that the front and the rear rolling portions 11,13 are contacted with the ground. Accordingly, when a user walks along the street with wearing on the shoe employing the shoe sole 1 according to the present invention, the cycle of a rotation, a rotation stop and an upright state of the ankle may be repeated due to the structure and the operation of the shoe sole 1. Because the ankle of the wearer can be rhythmically rotated, it is possible to prevent the wearer from turning his or her toes out and to softly train the ankle.

Since the cushioning member 16 made of a soft synthetic resin is installed at the front side and/or the rear side of the main body 10 or the cushioning means such as the tunnel-type through holes 17 are formed through the main body 10, it can provide good elastic air cushioning and shock-absorbing effects.

When a user walks and performs accompanying rolling of the foot along the street with wearing on the shoe employing the shoe sole 1 according to the present invention, the frictional resistance between the shoe sole 1 and the ground may be reduced at the valley portion 14. In other words, since the valley portions 14 are provided at the connecting positions between the front rolling portion 11 and the middle rolling portion 12 and between the middle rolling portion 12 and the rear rolling portion 13, the frictional resistance between the shoe sole 1 and the ground can be reduced. Accordingly, the same rolling of the foot at the front and the rear rolling portions 11,13 and the rotation of the middle rolling portion 12 can be quickly and smoothly performed. Consequently, it is possible to reform one's manner of walking by preventing a wearer from turning his or hers toes out and by allowing the wearer to perform triple time walks during the entire walking gait cycle of the wearer.

Having described shoe sole according to the preferred embodiments of the present invention in detail, the operation of preventing a wearer from turning his or hers toes in such as a step of a bow-legged person during the entire walking gait cycle of the wearer can be understood as follows with reference to FIGS. 8 to 12. The explanation of the triple time walks is the same as that of the explanation of the triple time walks as illustrated with reference to FIGS. 3 to 7. Accordingly, it should be noted that, for the sake of clarity, the detailed description of the triple time walks will be omitted.

Figure 10:
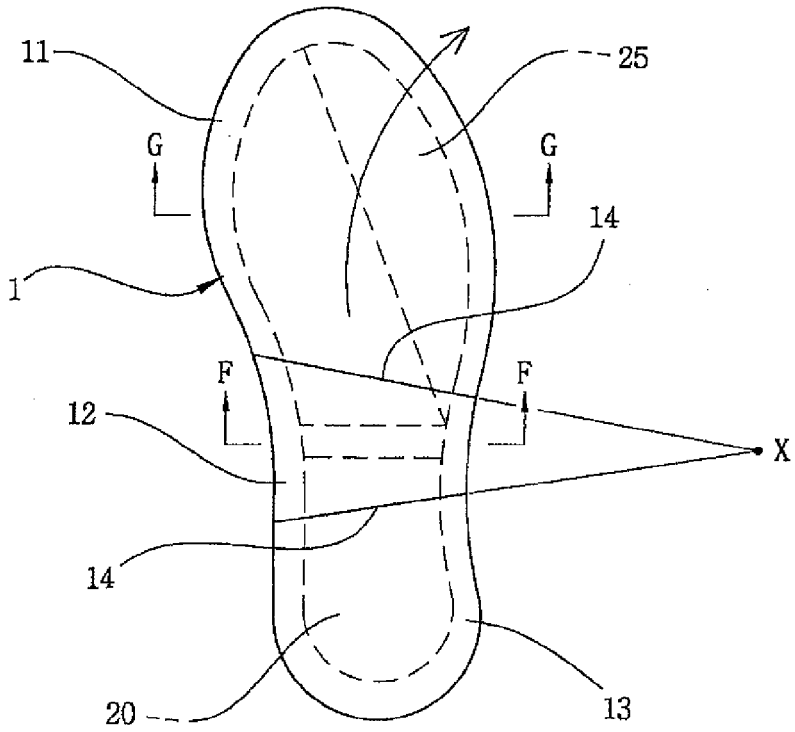

If a user puts on a shoe employing the shoe sole 1 according to the preferred third embodiment of the present invention as described above and walks on a road, the rear lower side of the rear rolling portion 13 corresponding to the heal zone of the shoe may be touched with the ground and continuously the lower surfaces of the middle rolling portion 12,11 may be touched with the ground in sequence with accompanying rolling of the foot. At this time, as shown in FIGS. 8, 10 and 11, the height and the width of the medial portion of the middle rolling portion are larger than those of the lateral portion of the middle rolling portion 12. Due to this structure of the middle rolling portion 12, the ankle has a tendency to naturally rotate outwards during walking and the accompanying rolling of the foot.

Furthermore, the medial edge portion of the sole of the foot may move upwards and continuously the lateral portion of the sole of the foot may move upwards at the time that the middle rolling portion 12 is contacted with the ground. As shown in FIGS. 9 and 12, since the lateral upwards rounded portion 25 provided at a front lateral portion of the hardened reinforcement sheet 20 of the shoe sole 1 upwardly supports the front lateral side of the sole of the foot, the front portion of the sole of the foot may be leveled off and simultaneously it is rotated to the outside.

Then, the front rolling portion 11 is contacted with the ground and the rotational movement towards to the outside may be stopped. Thereafter, the front portion of the sole of the foot returns to its initial state and it allows performing the same foot rolling function in a very natural way during the entire walking gait cycle of the wearer. As a result, the movement cycle of the ankle that is set to an upright state and a rotation state may be repeated again and again so that it is possible to prevent the wearer from turning his or hers toes in such as a step of a bow-legged person and to train the muscles of the ankle of the wearer.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A sole of a shoe for triple time walks and walking reform, comprising a bottom surface having a front rolling portion, a middle rolling portion and a rear rolling portion, the front, the middle and the rear rolling portions of the bottom surface of the sole together forming a substantially arc shape, the middle rolling portion being made of a rigid material having a rigidity substantially greater than the front and the rear rolling portions and the middle rolling portion protruding from the bottom surface of the sole beyond the front and the rear rolling portions, height and width in a longitudinal direction of the sole of a lateral portion of the middle rolling portion being greater than those of a medial portion of the middle rolling portion, and wherein a hardened reinforcement sheet is disposed within the sole in such a manner that it has a supporting portion protruding from a bottom surface of a bottom plate at a middle area thereof and a medial upwards rounded portion, in which a front medial portion of the bottom plate is rounded upwards so that it creates the medial upwards rounded portion, and in which the supporting portion is disposed in the middle rolling portion.

2. A sole of a shoe for triple time walks and walking reform, comprising a bottom surface having a front rolling portion, a middle rolling portion and a rear rolling portion, the front, the middle and the rear rolling portions of the bottom surface of the sole together forming a substantially arc shape, the middle rolling portion being made of a rigid material having a rigidity substantially greater than the front and the rear rolling portions and the middle rolling portion protruding from the bottom surface of the sole beyond the front and the rear rolling portions, height and width in a longitudinal direction of the sole of a medial portion of the middle rolling portion being greater than those of a lateral portion of the middle rolling portion, and wherein a hardened reinforcement sheet is disposed within the sole in such a manner that it has a supporting portion protruding from a bottom surface of a bottom plate at a middle area thereof and a medial upwards rounded portion, in which a front medial portion of the bottom plate is rounded upwards so that it creates the medial upwards rounded portion, and in which the supporting portion is disposed in the middle rolling portion.

3. The sole of a shoe for triple time walks and walking reform as claimed in claim 1 or 2, wherein cushioning means are provided at the front rolling portion and/or the rear rolling portion.

4. The sole of a shoe for triple time walks and walking reform as claimed in claim 3, wherein the cushioning means comprises a shock-absorbing recess defined in an underside of the rear side of the main body, in which a cushioning member of which a lower surface has a substantially arc shape is attached to an inner surface of the shock-absorbing recess.

5. The sole of a shoe for triple time walks and walking reform as claimed in claim 3, wherein the cushioning means comprises a through hole formed through the main body of the shoe sole in the horizontal directional.

* * * * *